US005945024A

United States Patent [19]

Fukunaga et al.

[11] Patent Number: 5,945,024

[45] Date of Patent: Aug. 31, 1999

[54] OVEN WITH ACCESSORY STORAGE

[75] Inventors: Eiji Fukunaga; Takaaki Hyodo; Katsunao Takahashi; Yuichi Otsuki, all of Otsu; Takumi Kawabata, Yasu-gun, all of Japan

[73] Assignee: Sanyo Electric Co., Ltd., Japan

[21] Appl. No.: 09/056,003

[22] Filed: Apr. 6, 1998

[30] Foreign Application Priority Data

Apr. 7, 1997 [JP] Japan ..... 9-105137
Aug. 27, 1997 [JP] Japan ..... 9-231177

[51] Int. Cl.[6] ..... H05B 6/64

[52] U.S. Cl. ..... 219/757; 99/450

[58] Field of Search ..... 219/757, 756, 219/754, 762, 623, 385, 392, 393; 126/39 B, 39 C, 37 R, 39 R, 30; 99/450, 484, 357, 340

[56] References Cited

U.S. PATENT DOCUMENTS 3,751,629 8/1973 Eisler et al. ..... 219/201
4,718,400 1/1988 Lotz et al. ..... 126/41 R
5,447,146 9/1995 Nickerson et al. ..... 126/339

FOREIGN PATENT DOCUMENTS 55-3213 1/1980 Japan .
57-119209 7/1982 Japan .
611746 11/1948 United Kingdom .

*Primary Examiner*—Teresa Walberg
*Assistant Examiner*—Jeffrey Pwu
*Attorney, Agent, or Firm*—Morrison Law Firm

[57] ABSTRACT

A heat cooker includes a generally box-like cooker body having ventholes at a bottom board thereof, a heating room disposed in the cooker body, a heat source disposed in the cooker body for heating foods in the heating room and an accessory storage section disposed under the bottom board of the cooker body, wherein the accessory storage section comprises a pair of leg bodies which support the cooker body and are attached on both sides of the bottom board and a plate-like accessory storage body which is supported by the leg bodies and inserted between the leg bodies to be capable of being pulled out forward, and wherein the leg bodies are further provided with ventilation slits that form an airway between an inside of the cooker body and an outside through the ventholes of the bottom board and an area above the plate-like accessory storage body.

12 Claims, 17 Drawing Sheets

OVEN WITH ACCESSORY STORAGE

BACKGROUND OF THE INVENTION

1. Field of the Invention

The present invention relates to a heat cooker. More particularly, the present invention relates to an accessory storage section disposed in a heat cooker.

2. Related Arts

A heat cooker generally comprises a box-like cooker body having ventholes at its bottom board, a heating room disposed in the cooker body and a heat source disposed in the cooker body for heating foods in the heating room. The heat source may employ a microwave generator, an electric heater and/or the like.

In the case of cooking by using a heat cooker, accessories are used which are provided as an addendum to the heat cooker, e.g., an oven plate, a gridiron, a recipe book, a heat insulation mitten, a handle for taking the oven plate out and the like depending on the needs. These accessories may include ones which are rarely used by a cook depending on how the cooker is used. Then, it is not easy to secure enough space for storing such accessories. Additionally, there is a problem such that it is not easy to take accessories out when it is necessary if these are once stored.

In order to solve this problem, a heat cooker with an accessory storage section at the bottom part thereof is disclosed, e.g., in Japanese Unexamined Utility Model Publications Nos. SHO 55(1980)-3213 and SHO 57(1982)-119209.

However, the above-mentioned storage section is used for inserting accessories into a storage space at the bottom part of the cooker. Therefore, it is very inconvenient for taking accessories in and out. Moreover, small accessories tend to be put in an innermost part, as if they were missing, so that there is a fear that they become useless because they cannot be found when they are needed.

Moreover, there is a fear that the accessories block ventholes formed on the bottom part of the heat cooker, so that it prevents discharge of heat from control devices of the heat cooker.

The purpose of the present invention is to provide a heat cooker equipped with an accessory storage section without preventing discharge of heat from the inside of the cooker body.

SUMMARY OF THE INVENTION

Thus, the present invention provides a heat cooker comprising a generally box-like cooker body having ventholes at a bottom board thereof, a heating room disposed in the cooker body, a heat source disposed in the cooker body for heating foods in the heating room and an accessory storage section disposed under the bottom board of the cooker body, wherein the accessory storage section comprises a pair of leg bodies which support the cooker body and are attached on both sides of the bottom board and a plate-like accessory storage body which is supported by the leg bodies and inserted between the leg bodies to be capable of being pulled out forward, and wherein the leg bodies are further provided with ventilation slits forming an airway between an inside of the cooker body and an outside through the ventholes of the bottom board and an area above the plate-like accessory storage body.

According to the present invention, cooling of the inside of the cooker body is not prevented even if the accessory storage section including a structure for inserting the plate-like accessory storage body between the leg bodies is disposed under the bottom board of the cooker body, because the leg bodies constituting the accessory storage section are provided with ventilation slits that form an airway between the inside of the cooker body and the outside through the ventholes of the bottom board of the cooker body and an area above the plate-like body.

The heat source to be used in the present invention may employ microwave heating by a magnetron, heater heating by a heater or the like.

Examples of accessories in the present invention include an oven plate, a gridiron, a recipe book, a heat insulation mitten and a handle for taking the oven plate out.

The ventilation slits in the present invention are constructed so as to form an airway between an inside of the cooker body and an outside through the ventholes of the bottom board and an area above the plate-like accessory storage body. In disposing the ventilation slits, it is necessary to determine a size, a quantity and an arrangement thereof specifically.

The heat cooker of the present invention is further provided with a spacer protruding from the lower surface of the bottom board toward an inside of the plate-like accessory storage body in order to form a space for ventilation between the accessories stored in the plate-like body and the bottom board, thereby forcibly forming an airway between an inside of the cooker body and an outside through the ventholes of the bottom board and an area above the plate-like accessory storage body.

Especially, in the heat cooker comprising a plate disposed in the heating room for placing foods thereon, a rotating motor for rotating the plate at the time of heating by the heat source and a motor-storing recess formed by allowing the bottom board to partially protrude downward in order to store the rotating motor between the heating room and the bottom board of the cooker body, this spacer is preferably disposed under the motor-storing recess.

Alternatively, the spacer may have a "U"-shaped cross section and is disposed on the bottom board so as to form an airway for ventilation, the airway being parallel to a lower front end of the heating room. This allows the airway for ventilation to be secured and, moreover, smooth movements to put the plate-like body into the accessory storage section may be performed without the accessories being caught.

Still alternatively, the spacer may comprise at least one elongated protection formed to protrude downward by embossing the bottom board. In this case, since the elongated protection can be formed simultaneously at the time of producing the bottom board, the production process thereof becomes easier. Additionally, since round edges can be formed, the accessories are not caught by the edges.

Further, each of the leg bodies is preferably provided with a guide rail extending in a rearward direction for slidably supporting the plate-like accessory storage body. In this case, the plate-like body with the accessories stored therein can be drawn out directly forward, so that less power is needed for drawing the plate-like body out.

Further, each of the leg bodies is preferably provided with a recess formed in an outer periphery of said each of the leg bodies in order to form a handhold surface on both ends of the bottom board for lifting up the cooker body. This makes it easier to lift up and transfer the cooker body.

Especially, when the heat cooker further comprises a control component disposed beside the heating room of the cooker body for supplying electric power to and controlling the heat source, the recess located nearer to the control component is preferably larger than the other recess.

Further, the plate-like accessory storage body is preferably provided with a step section disposed at least at one of intersecting lines formed by an inside bottom surface of the plate-like body and right, left and rear side surfaces thereof in order to center the accessories to be stored in the plate-like body away from at least one side of the plate-like body, the step section being formed to lack a portion of a front part in the direction from the front to the back, whereby an accessory picking space is formed for picking up the accessories stored in the plate-like body. This allows the outer periphery of the accessories to be spaced apart from the side surface of the plate-like body and therefore, the outer periphery of the accessories stored in the plate-like body can be lifted up with hands from the accessory picking space.

Still further, the plate-like accessory storage body is constructed to be capable of being inserted to a position such that the front upper edge of the plate-like body is behind the front upper edge of the heating room. This prevents dropping of broken pieces and dregs of food materials to be heated from the heating room into the plate-like body and thereby, the inside of the plate-like body can be kept clean.

Furthermore, the plate-like accessory storage body is preferably provided with ventholes on the bottom part thereof in order to form an airway between the inside of the cooker body and the outside through the ventholes of the bottom board and an inside of the plate-like body. This can further improve efficiency of cooling an apparatus in the cooker body.

DETAILED DESCRIPTION OF THE PREFERRED EMBODIMENTS

Hereafter, the present invention is described with reference to the preferred embodiments illustrated by accompanying drawings. However, the embodiments described below are not intended to limit the scope of the present invention.

Figure 1:
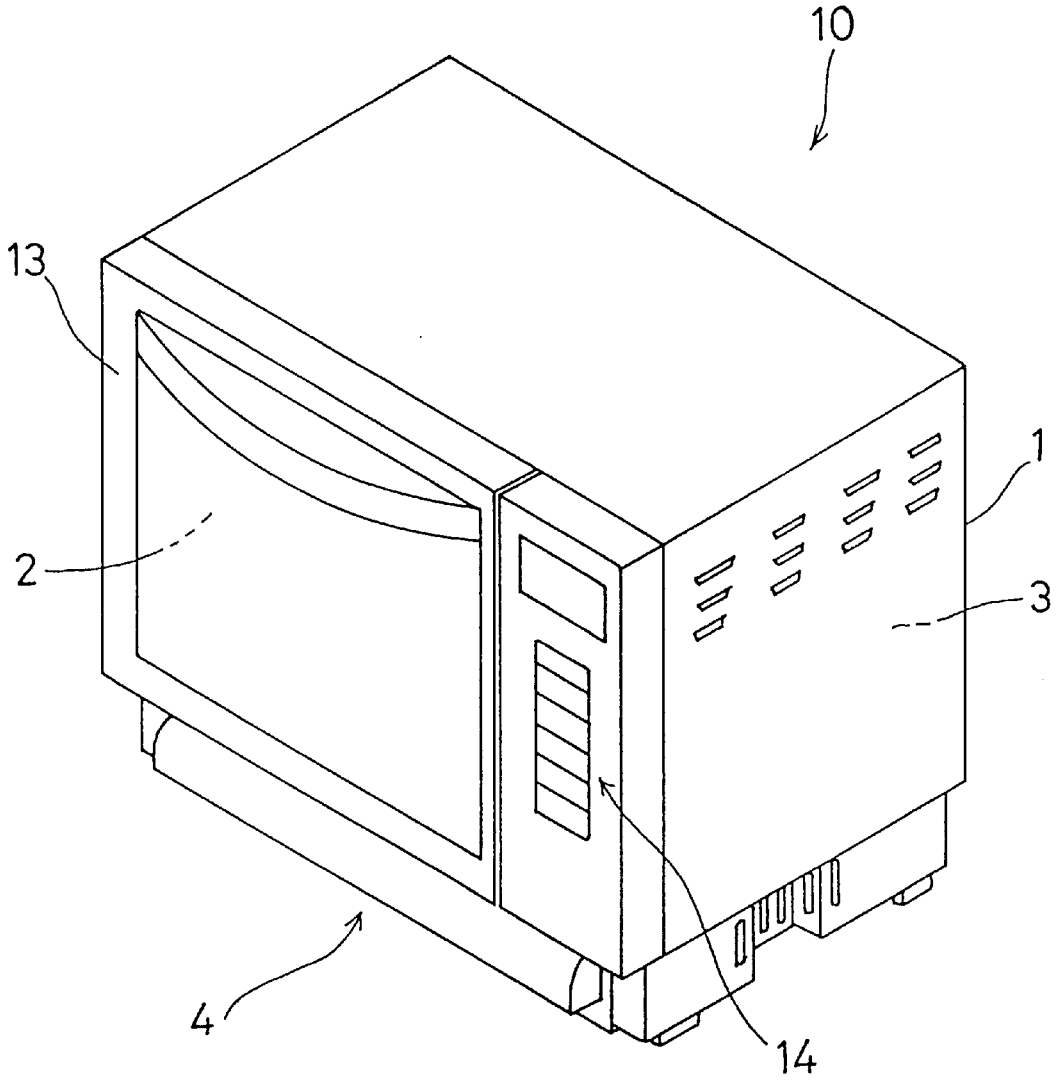
FIG. 1 is a perspective view of an oven-range according to an embodiment of the present invention.
Figure 2:
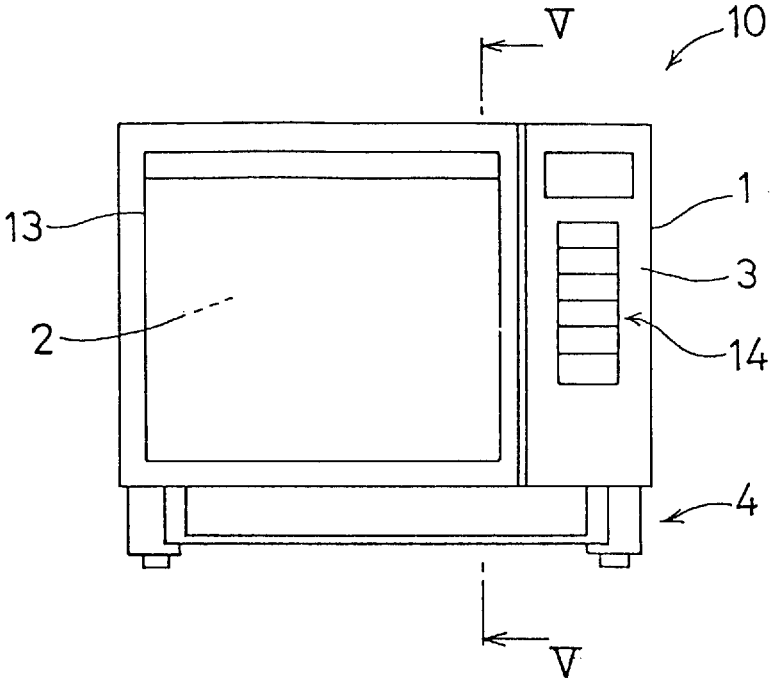
FIG. 2 is a front view of the oven-range of FIG. 1.
Figure 3:
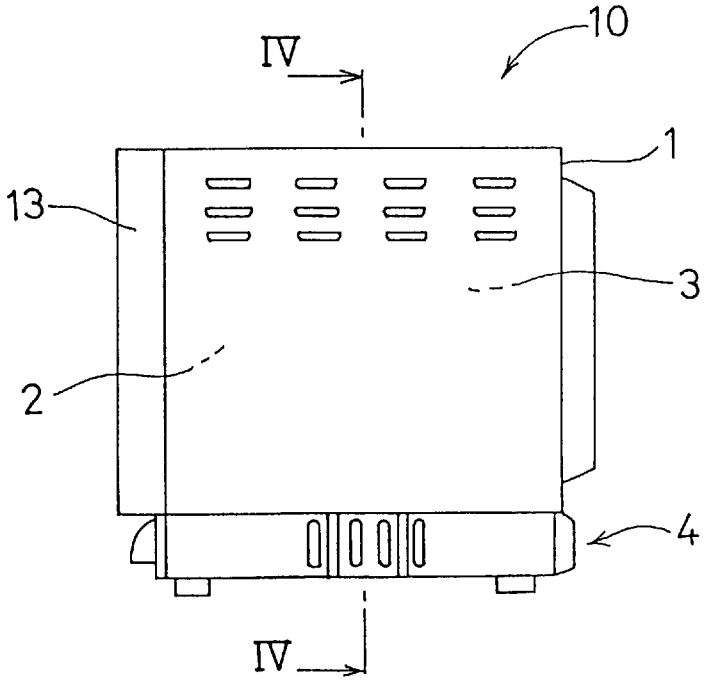
FIG. 3 is a side view of the oven-range of FIG. 1.

FIGS. 1 to 3 show a microwave oven with a heating function provided by a heater (hereafter referred to as an oven-range) in accordance with an embodiment of the heat cooker in the present invention. The oven-range 10 is mainly constructed with an apparatus body 1 constituting a cooker body, a heating room 2 disposed in the apparatus body 1, a high frequency supply section 3 disposed in the apparatus body 1 and an accessory storage section 4 disposed under the apparatus body 1.

Figure 4:
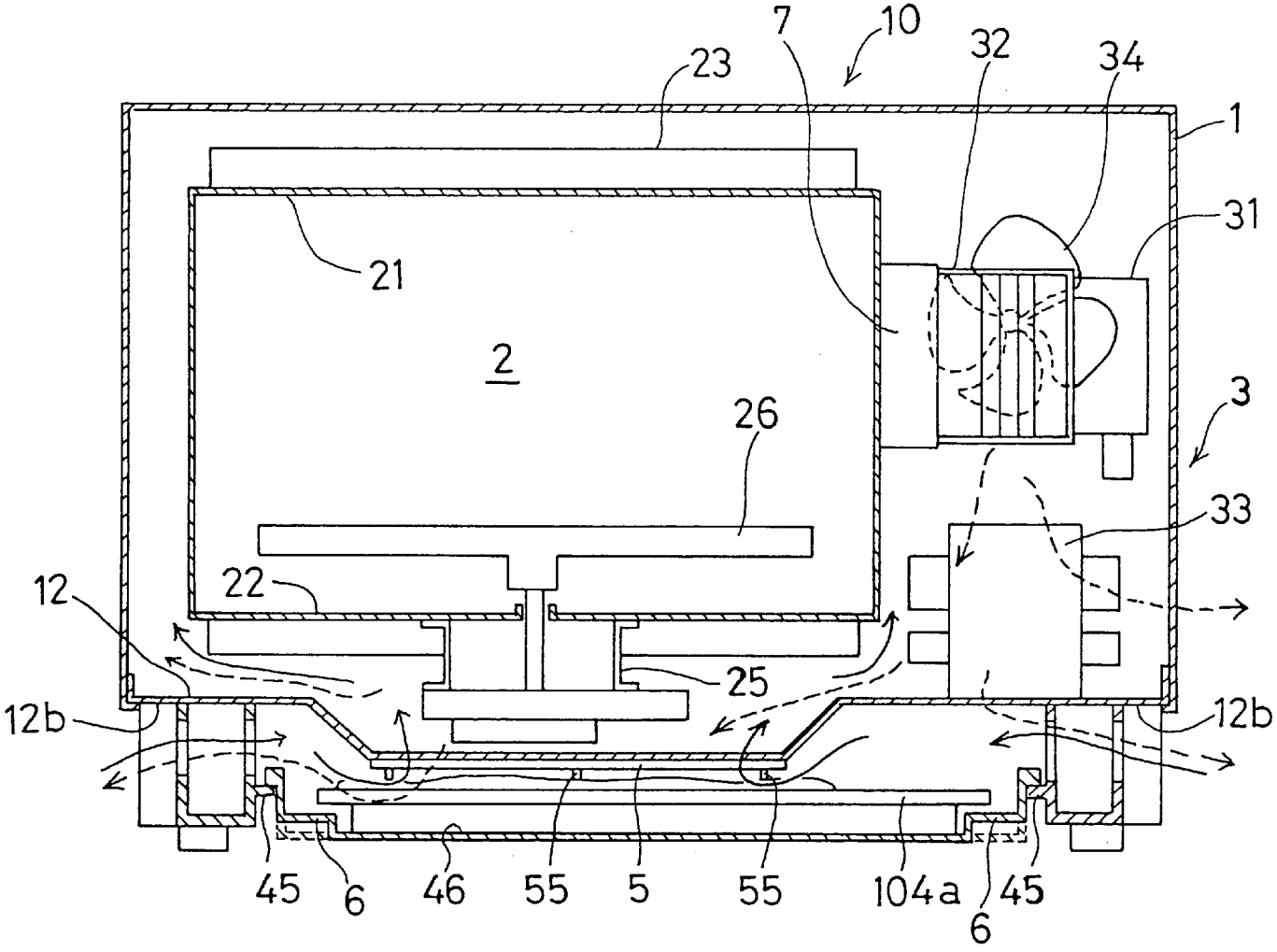
FIG. 4 is a sectional view of FIG. 3 cut along a IV—IV line in FIG. 3.
Figure 5:
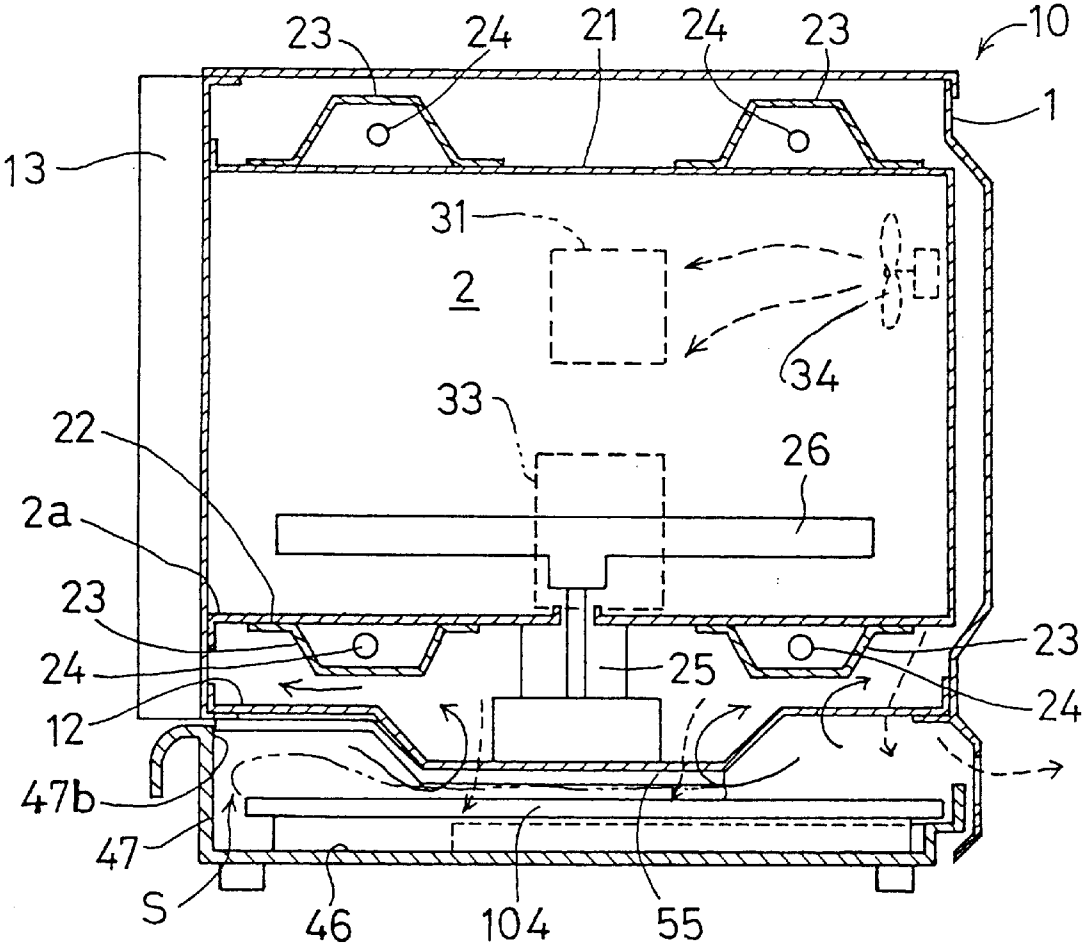
FIG. 5 is a sectional view of FIG. 2 cut along a V—V line in FIG. 2.

The apparatus body 1 is mainly box-like and made of galvanized steel plates. A base of the apparatus body 1 is made of a bottom board 12 (for example, see FIG. 4) having ventholes mentioned below. A front of the apparatus body 1 is provided with a door 13 and an operation panel 14 having a control section which is not shown in FIG. 1. The high frequency supply section 3 is disposed behind the operation panel 14 in the apparatus body 1. The high frequency supply section 3 comprises a magnetron 31, a waveguide 32 and a high-voltage transformer 33 as shown in FIGS. 4 and 5. One end of a waveguide 7 is connected to the magnetron 31 and the other end thereof is open to the heating room 2. A cooling fan 34 is disposed behind the magnetron 31 and the high-voltage transformer 33 for supplying a high voltage to the magnetron 31 is disposed below the fan 34.

The heating room 2 is box-like and made of steel plate with an open front. A ceiling board 21 and a bottom board 22 each are provided with a tubular heater 24 and a heater cover 23 constituting a reflection board, the tubular heater 24 and the heater cover 23 facing the heating room 2. Further, a turntable 26 as a plate for placing a stuff to be heated is rotatably held on the bottom board 22, the turntable being supported by a geared motor 25 constituting a rotary motor disposed under the bottom board 22.

Figure 6:
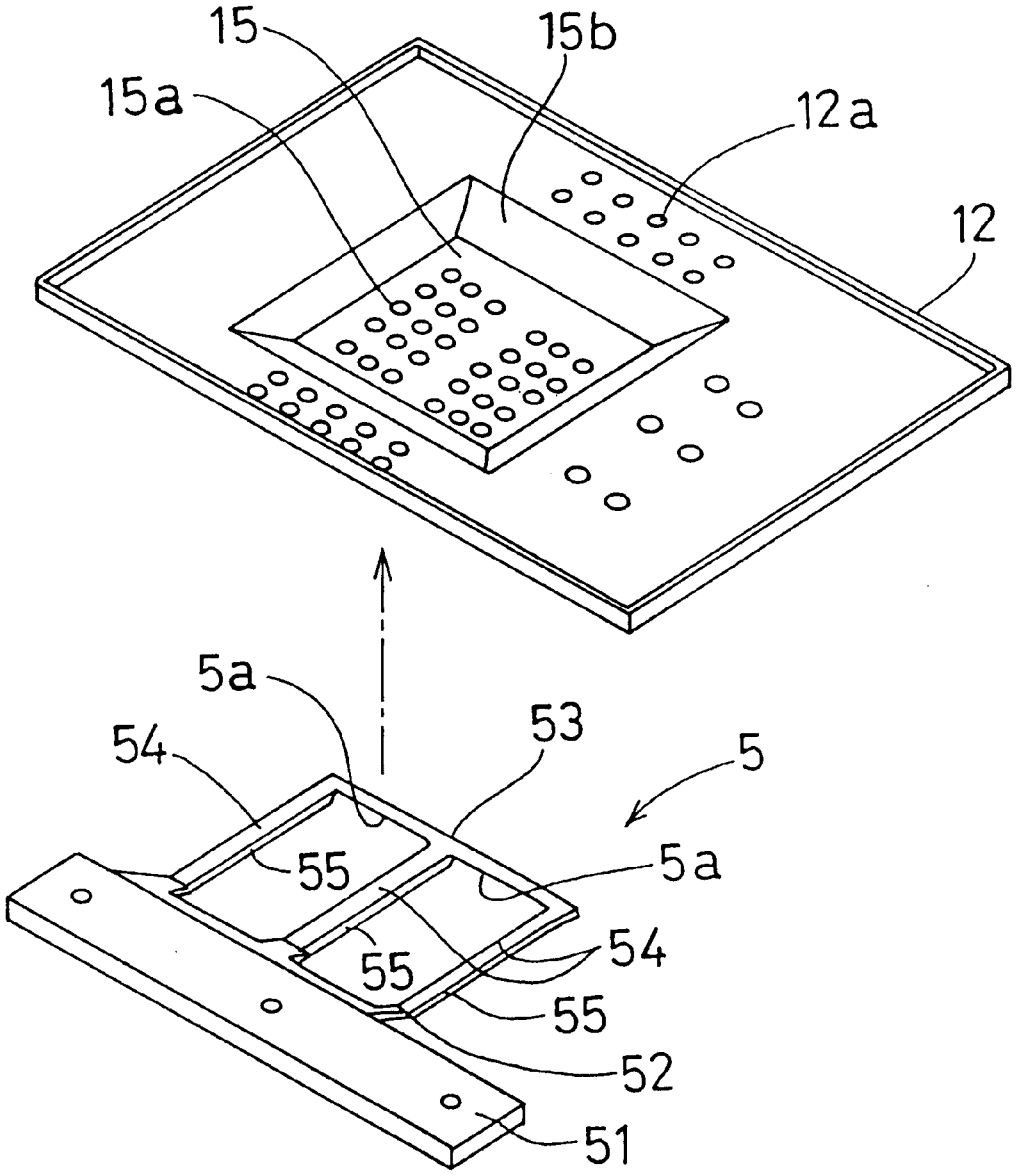
FIG. 6 is an upper perspective view of a bottom board and a spacer of FIG. 1.

Referring to FIG. 6, the bottom board 12 is a rectangular steel plate formed along the bottom board of the apparatus body 1. Generally on the left of the center of the bottom board 12, a motor-storing recess 15 protruding downward via a step section **15*b* is formed in order to prevent contact of the bottom board to the geared motor 25 in FIGS. 4 and 5. A plurality of ventholes 12*a* and 15*a* are formed on the front, back and around the right side of the recess 15 and the bottom part of the recess 15**.

The step section **15*b* has no ventholes. If ventholes are provided on the step section 15*b*, there is a fear that, when the plate-like body 46 is pulled out from the accessory storage section 4 and a metallic stick is inserted into an open space formed by pulling the plate-like body 46 in FIGS. 4 to 7, the geared motor 25 located above the bottom board 12 may be poked and damaged by the metallic stick penetrating through the venthole on the step section 15*b***. Therefore, no ventholes are disposed there.

Under the bottom board 12, a spacer 5 is disposed which forms a space for ventilation mentioned below between accessories to be stored in the plate-like body 46 and the bottom board 12.

The spacer 5 is a frame body made of steel plate, comprising a mounting base section 51 and a spacer body section 53 extending rearward from the mounting base section 51 via a downward slope section 52. Two rectangular openings 5*a* are formed in the combined area of the downward slope section 52 and the spacer body section 53. Under three longitudinal sides of rectangle sections 54 extending in a rearward direction to form the rectangular openings 5*a*, vertical pressing pieces 55 are disposed extending in the rearward direction along the longitudinal side of the rectangle 54 and vertically protruding downward. The spacer 5 is, as shown in FIGS. 4 and 5, mounted onto a lower surface of the bottom board 12 by means of the mounting base 51, so that the vertical pressing pieces 55 protrude from the bottom board 12 to the inside of the plate-like body 46. The accessory storage section 4 is disposed under the spacer 5.

Figure 7:
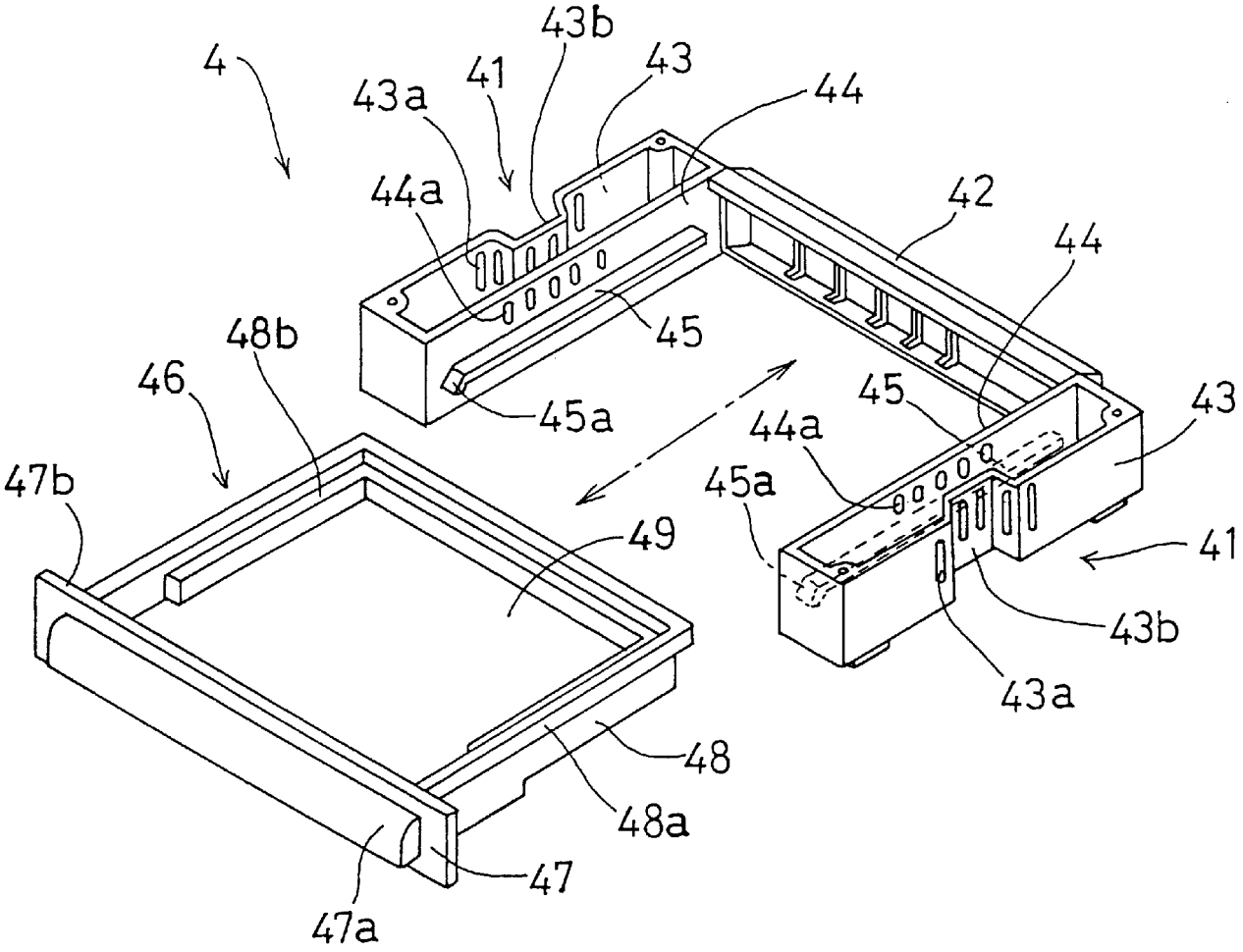
FIG. 7 is an upper perspective view for explaining a structure of accessory storage section of FIG. 1.

The accessory storage section 4 is mounted to the bottom board 12 on both right and left sides thereof (in FIG. 4) and comprises a pair of leg bodies 41 supporting the apparatus body 1, a back cover 42 disposed between the two leg bodies 41 and a plate-like accessory storage body 46 which is supported by the leg bodies 41 and inserted in a space between the leg bodies 41 so as to be capable of being pulled out as shown FIG. 7. The leg bodies 41, the back cover 42 and the plate-like body 46 are molded members made from a polypropylene resin. The resin forming the accessory storage section 4 may be a synthetic resin material having a heat resistance to temperature of 60° C. or higher, but is not limited to a polypropylene resin.

The leg bodies 41 are formed like a parallelepiped container having a rectangular cross section and disposed symmetrically with each other. Outer side boards 43 extend rearward along the right and left sides of the bottom board 12. Inner boards 44 extend to face each other with the surfaces of the inner boards 44 being parallel. At a center part of the outer side board 43 and the inner board 43 as viewed in the direction from the front to the back, a plurality of ventilation slits 43*a* and 44*a* are provided in order to form an airway between the inside of the apparatus body 1 and the outside through the ventholes 12*a* and 15*a* on the bottom board 12 and the area above the plate-like body 45, respectively.

At the center part of the outer side boards 43 as viewed in the direction of the front to the back, handhold recesses 43*b* are disposed in order to form handhold surfaces 12*b* (FIG. 4) having a sufficient width for lifting up the oven-range 10 on the right and left ends of the bottom board 12. The handhold recesses 43*b* are inwardly caved.

Figure 8:
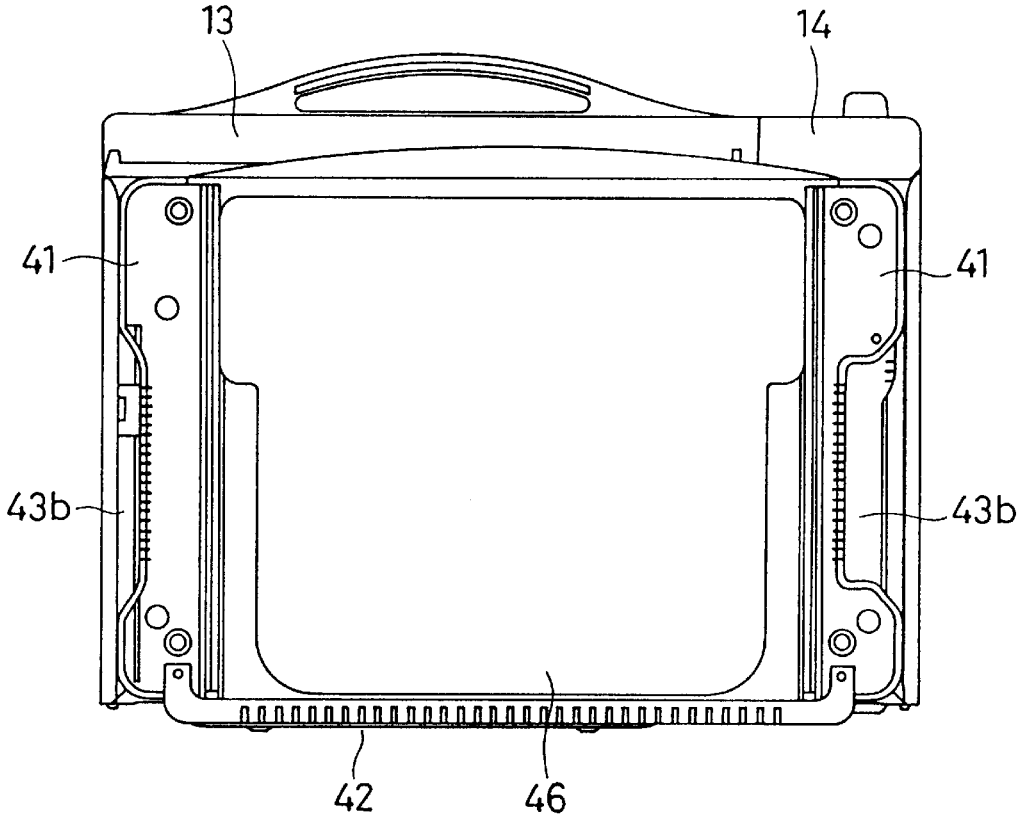
FIG. 8 is an bottom view of the oven-range of FIG. 1.

Especially, as shown in FIG. 8, when the handhold recess 43*b* at the side where the high frequency supply section 3 constituting a control component is disposed (FIG. 4), i.e., at the side where the operation panel 14 is disposed, is constructed to be wider than the other handhold recess 43*b* provided at the opposite side, it is easier to lift the oven-range 10 up. This is because the side where the high frequency supply section 3 is disposed, i.e., the side having the components like the high-voltage transformer 33 (FIG. 4) is heavier than the other side, so that a wider handhold section helps a user to lift it up.

At the center of the inner boards 44 as viewed in a vertical direction, rearwardly extending guide rails 45 are disposed facing each other and are integral with the leg body 41. Each of the guide rails 45 is capable of holding the edge of the opening of the plate-like accessory storage body 46 mentioned below, has a constant width, protrudes into the inside and is provided with a guiding slope 45*a* at a front end thereof for guiding the plate-like body 46 in and out.

The back cover 42 has a "U"-shaped cross section and is a stick-like member extending in the direction from the right to the left, partially having ventholes. The right and left ends of the back cover 42 are engaged with and fixed to the back part of the inner board 44 and the back cover 42 works as a cover for protection of the accessory storage section 4 against dust.

The plate-like accessory storage body 46 is formed like a parallelepiped container having a rectangular cross section, comprising a front board 47 having a handle 47*a* for pulling the plate-like body forward and a storage body section 48 for storing accessories. An edge of the opening of the storage body section 48 has a constant width except the front part thereof and forms a horizontally protruding flange 48*a* for sliding movement, the lower side of the flange 48*a* being slidably supported by the upper side of each guide rail 45. A pair of guide rails 45 are capable of holding the plate-like body 46 inserted between the right and left leg bodies 41, keeping the plate-like body 46 parallel to the bottom board. The storage body section 48 is provided with a step section 48*b* in order to center the accessories to be stored in the plate-like body 46, especially an oven plate mentioned below, in the storage body section 48 away from either side of the storage body section 48, the step section being disposed at three intersecting lines formed by the inside bottom surface 49 and the right, left and rear side surfaces. Additionally, the step section 48*b* is formed to lack about a third of the front part in the direction from the front to the back, whereby an accessory picking space 6 (FIG. 4) can be formed for picking up the oven plate stored in the storage body section 48.

When the plate-like body 46 is inserted between the right and left leg bodies 41, an upper end 47*b* of the front board 47 can retreat to the position of nearly touching a front end of the bottom board 12 (FIG. 5), so that the upper end 47*b* is retained behind the edge 2*a* of the front surface of the heating room 2. Therefore, it can prevent dropping of broken pieces of food materials to be heated from the edge 2*a* of the heating room into the storage body section 48.

Figure 9:
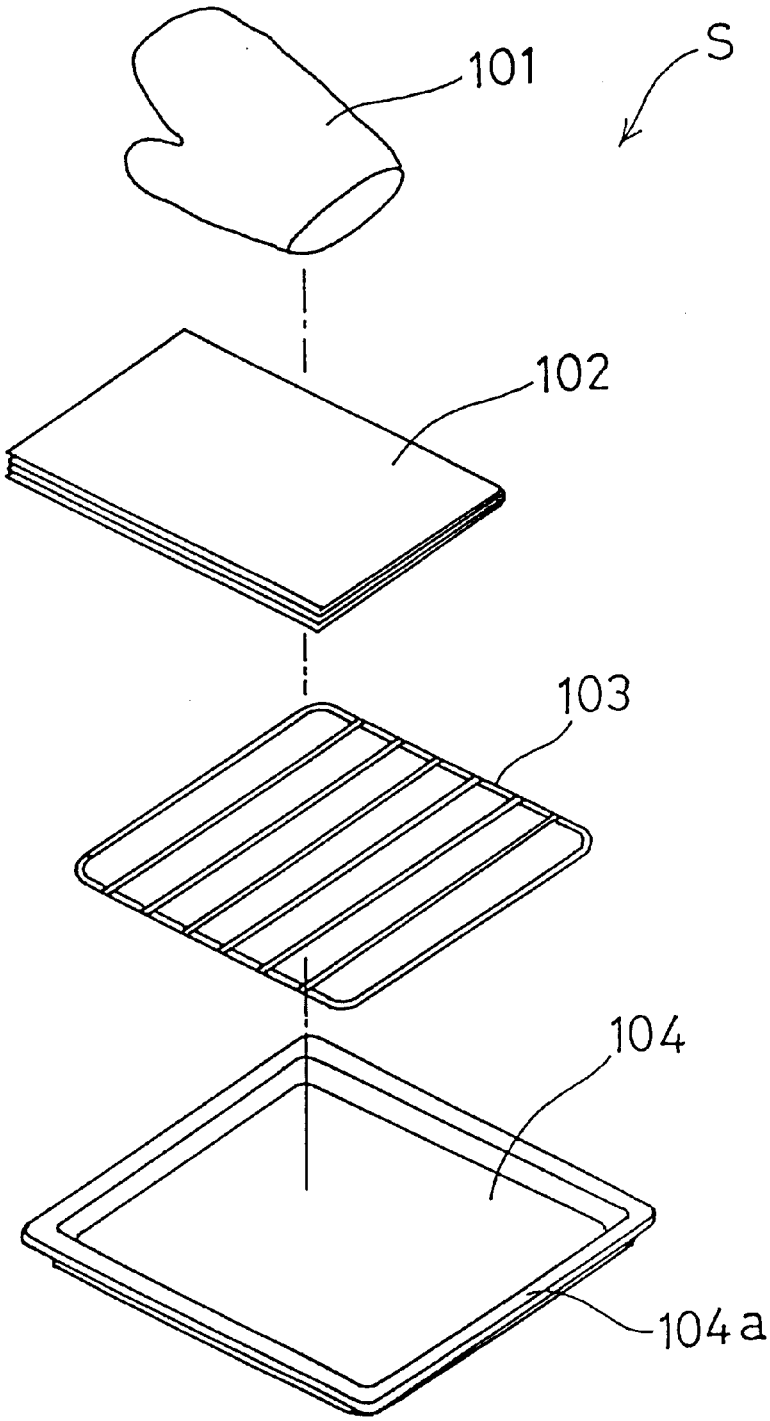
FIG. 9 is a perspective view showing examples of accessories to be stored in the accessory storage section of FIG. 1.

FIG. 9 shows concrete examples of storable accessories in the accessory storage section 4. Examples of accessories S are a heat insulation mitten 101, a recipe book 102, a gridiron 103, a square oven plate 104 and a handle for taking the oven plate out (not shown). A lower surface of the bottom of the oven plate 104 is held by the upper surface of the bottom 49 of the storage body section 48, whereby a lower surface of an outwardly and almost horizontally protruding edge 104*a* and an upper surface of the step section 48*b* of the storage body section 48 are spaced apart.

As for ventilation in the oven-range 10, especially ventilation around the accessory storage section 4, an air flow is shown by an arrow illustrated in FIGS. 4 and 5. A broken arrow represents an air flow in the case of high-frequency heating by operating the high frequency supply section 3. A solid arrow represents an air flow in the case of oven heating by operating the heater 24. When the plate-like body 46 is inserted between the left and right leg bodies 41 and the above-mentioned accessories S are stored in the plate-like body 46, the heat insulation mitten 101 or the like are pressed down by the vertical pressing pieces 55 placed above the accessories S even if the accessories S are bulky, and a space for ventilation is secured between the accessories S and the bottom board 12.

In the case of high-frequency heating, an air flow generated by the cooling fan 34 cools the magnetron 31, the high-voltage transformer 33 and inner apparatuses such as the geared motor 25, and a part of the air flow is discharged from the side board of the apparatus body 1 to the outside. Further, some of the air flow passes over the plate-like body 46 through the ventholes 12*a* and 15*a* of the bottom board 12 and is discharged through the ventilation slits 44*a* and 43*a* to the outside. Since the above-mentioned space for ventilation is secured by the vertical pressing pieces 55 between the lower surface of the recess 15 of the bottom board 12 and the accessories S stored in the plate-like body 46, sufficient ventilation is provided also through the ventholes 15*a* of the recess 15, so that cooling of the inner apparatuses is not prevented by the accessory storage section 4.

In the case of oven heating, a natural air convection generated inside of the apparatus body 1 by heating of the heater 24 forms a cooling air flow which flows towards the apparatus body 1 from the outside. A fresh air flows inside from the ventilation slits 43*a*, passes through the inside ventilation slits 44*a* and over the plate-like body 46, and then a part of the above-mentioned fresh air flows into the apparatus body 1. Moreover, a part of the above-mentioned fresh air passes through the room for ventilation ensured by the vertical pressing pieces 55 between the lower surface of the recess 15 of the bottom board 12 and the accessories S, and flows into the apparatus body 1 through the ventholes 15*a*. This air flow cools the inner apparatuses such as the geared motor 25 and prevents a damage thereof. Moreover, the vertical pressing pieces 55 keep the accessories S away from the comparatively hot bottom board 12, so that a safe storage of the accessories S can be maintained.

Figure 10:
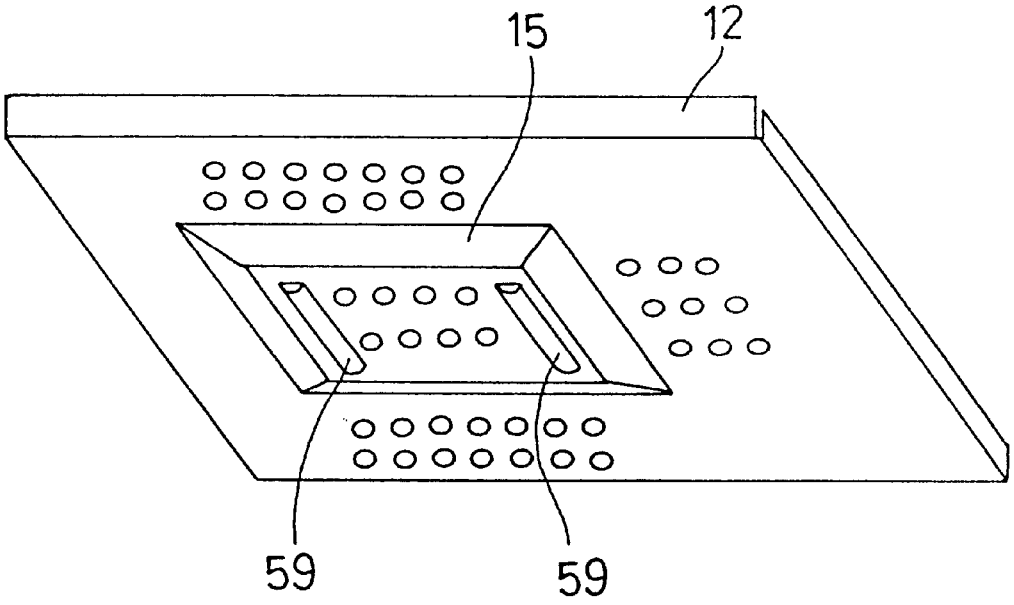
FIG. 10 is an upper perspective view for explaining an embodiment of the bottom board and the spacer.
Figure 11:
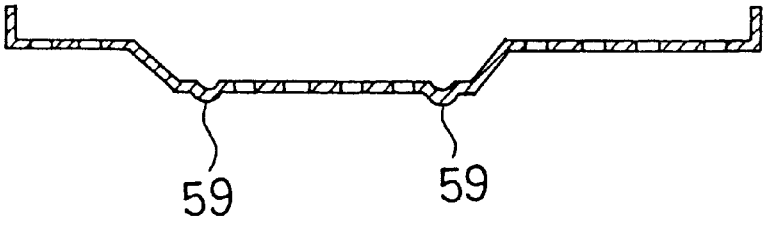
FIG. 11 is a sectional view of an essential part of FIG. 10.

In the above embodiment, the spacer 5 is constructed with the vertical pressing pieces 55 which protrude to the inside of the plate-like body 46 inserted between the leg bodies 41, the spacer 5 being disposed under the bottom board 12. However, as shown in FIGS. 10 and 11, a pair of elongated projections 59 formed to protrude downward by embossing the bottom board 12 can act as a spacer that forms a space for ventilation between the accessories S to be stored in the plate-like body 46 and the bottom board 12 as mentioned above. Because the elongated projections 59 may be formed by embossing simultaneously with making holes for the ventholes 12*a* at the time of forming the bottom board 12, the production process becomes easier. Moreover, since round edges can be formed, the accessories S are not caught by the elongated projections 59.

Figure 12:
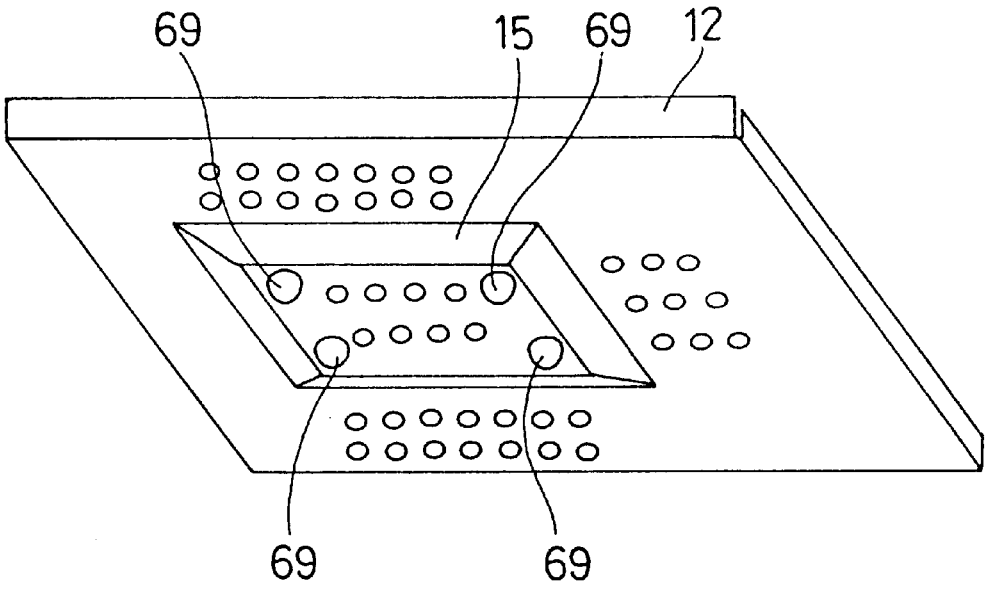
FIG. 12 is a view corresponding to FIG. 10 for explaining another embodiment of the spacer.
Figure 13:
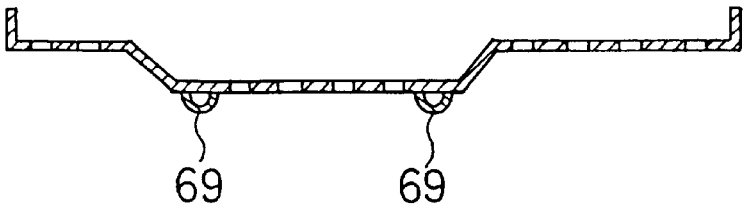
FIG. 13 is a sectional view of an essential part of FIG. 12.
Figure 14:
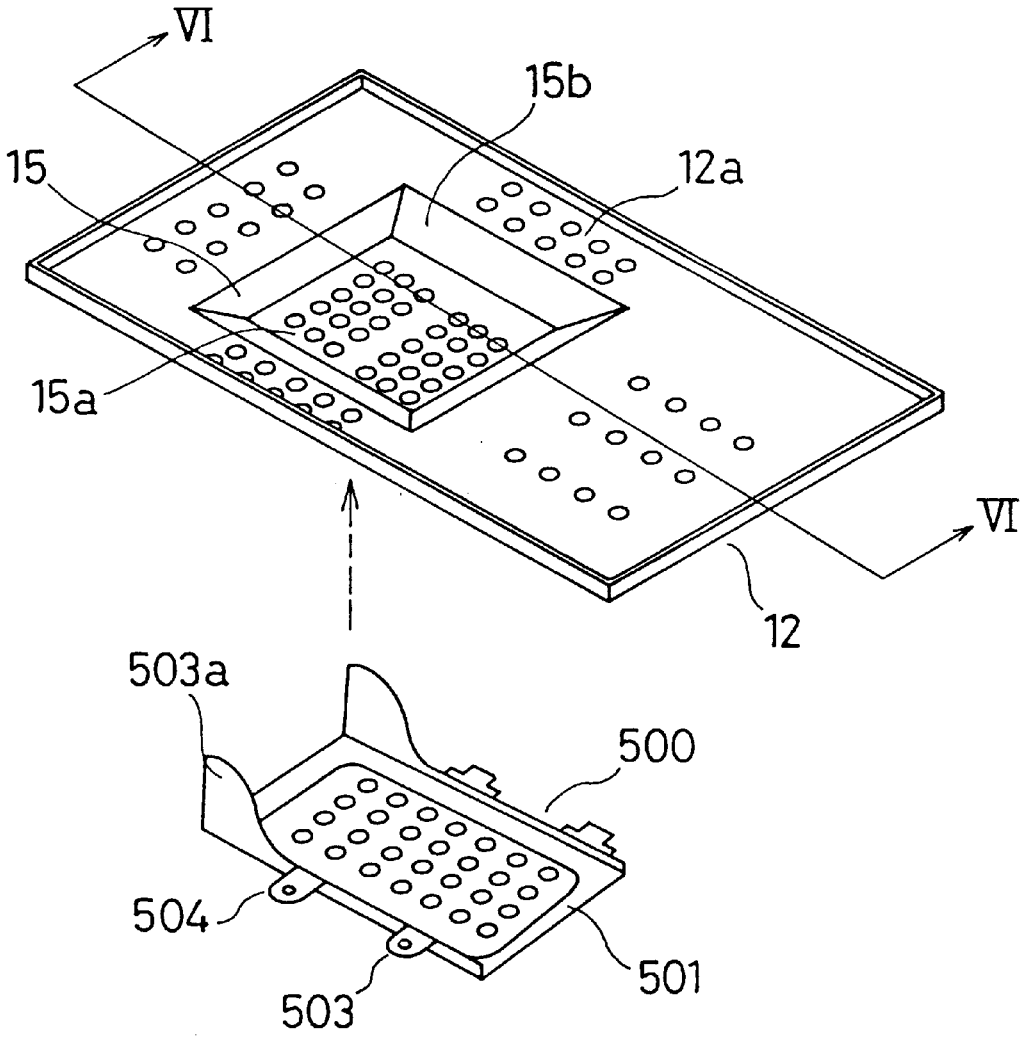
FIG. 14 is a view corresponding to FIG. 6 for explaining another embodiment of the spacer.

Another embodiment of the spacer 5 is shown in FIGS. 12 and 13. Here, at four corners of the lower surface of the bottom board 12, a hemisphere 69 made of a synthetic polymer is disposed to protrude downward and can act as a spacer that forms a space for ventilation between the accessories S to be stored in the plate-like body 46 and bottom board 12 as in the above-mentioned embodiment. The hemisphere 69 may be fixed to the bottom board 12 by allowing at least one engagement projection (not shown) protruding upward from the upper flat surface of the hemisphere 69 to engage with the engagement hole (not shown) of the bottom board 12. Also in this case, the accessories S can be prevented from being caught by the hemispheres 69.

Because the leg bodies 41 are formed in a container-like shape, they have enough strength and contacting area so as to support the oven-range 10 stably.

Because the leg bodies 41 each are provided with a guide rail 45 which is formed integral with the leg body and extends in the direction from the front to the back, the plate-like body 46 may be pulled out directly forward with small power. Moreover, it is not necessary to attach an additional separate component as a guide rail. Moreover, because the leg bodies 41 are provided with the handhold recesses 43*b*, the handhold surfaces 12*b* for lifting up the oven-range 10 are formed at the right and left outer ends of the bottom board 12 and therefore, it is easier to lift up and transfer the oven-range 10.

The plate-like body 46 is provided with step sections 48*b* which are formed to lack a portion of the front part, whereby the space for lighting up the oven plate stored in the plate-like body 46 can be formed, so that the oven plate 104 can be kept apart from the side surface of the plate-like body 46 and thereby, the oven plate 104 and the accessories stored therein can be easily taken out from the plate-like body 46. Moreover, because the plate-like body 46 is constructed to be capable of being inserted to a position behind the edge 2*a* of the heating room 2, it can prevent dropping of materials to be cooked from the heating room 2 into the plate-like body 46 and thereby, the inside of the plate-like body 46 can be kept clean.

FIGS. 14 to 17 are views for explaining a spacer 500 as another embodiment of the spacer 5 in FIG. 6.

The spacer 500 comprises a rectangular base board 501 having a plurality of ventholes 502, a side board 503 disposed on the longitudinal side of the base board 501 to secure a space for ventilation between the base board 501 and the bottom board 12 and a fixing piece 504 extending from a portion of the side board 503 contacting the bottom board 12 for fixing the spacer 500 to the bottom board 12 by fastening screws. That is, the spacer 500 is formed like a ditch having a "U"-shaped cross section.

Figure 15:
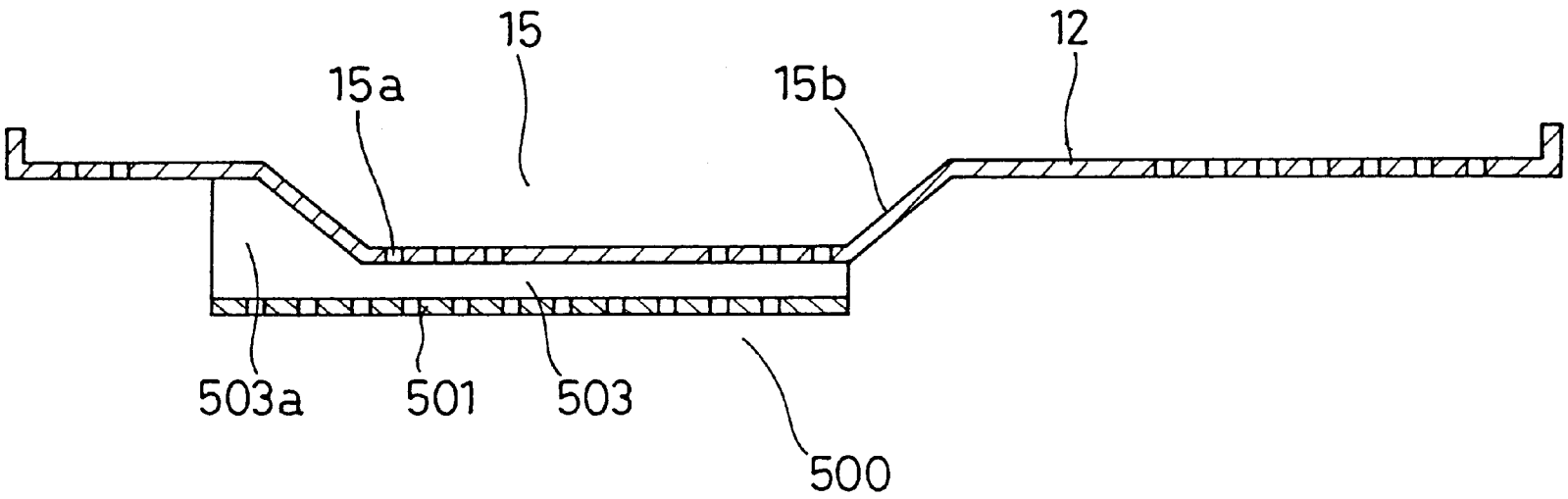
FIG. 15 is a sectional view of FIG. 14.
Figure 16:
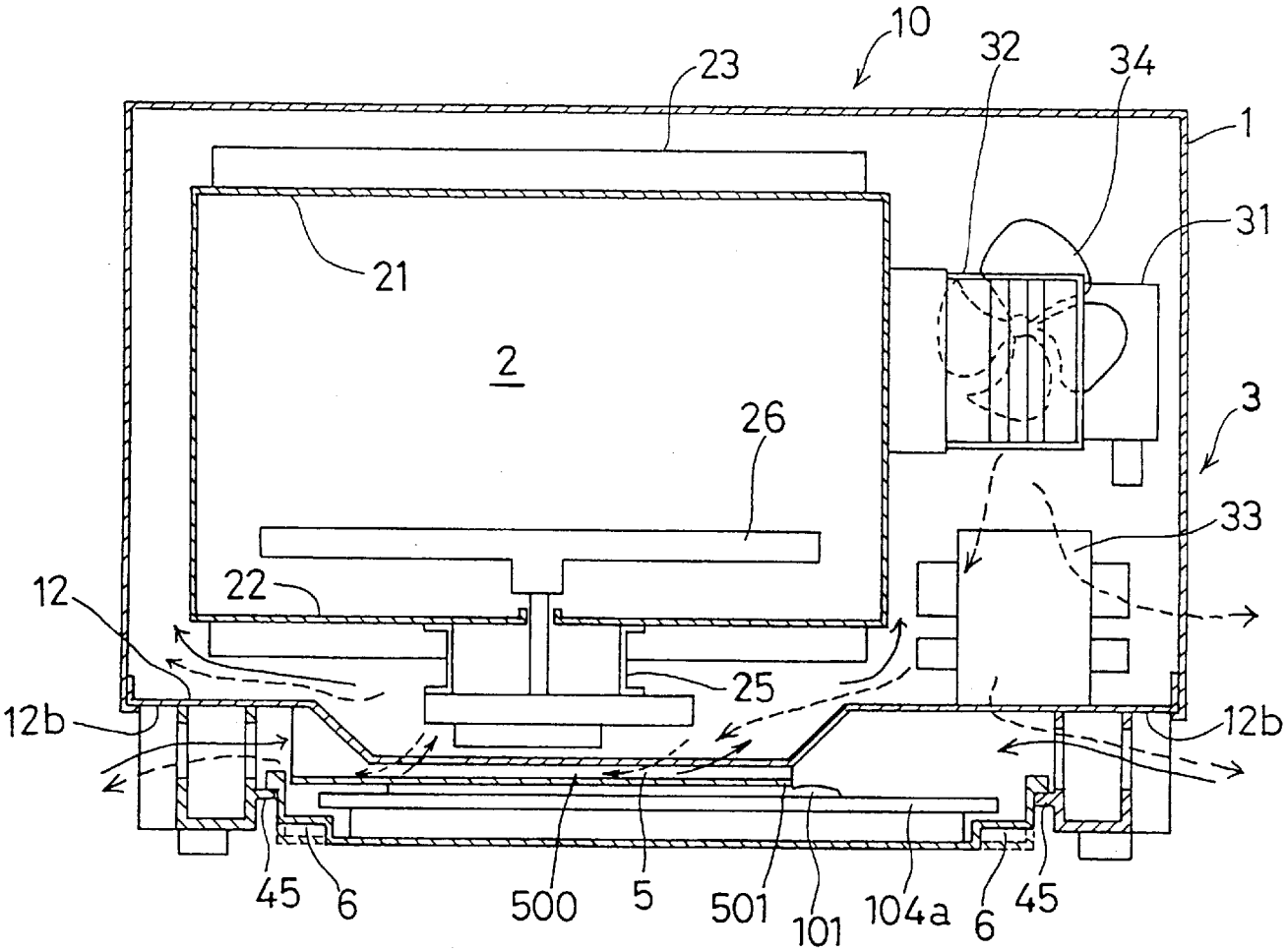
FIG. 16 is a front sectional view of the oven-range having the spacer shown in FIG. 14.
Figure 17:
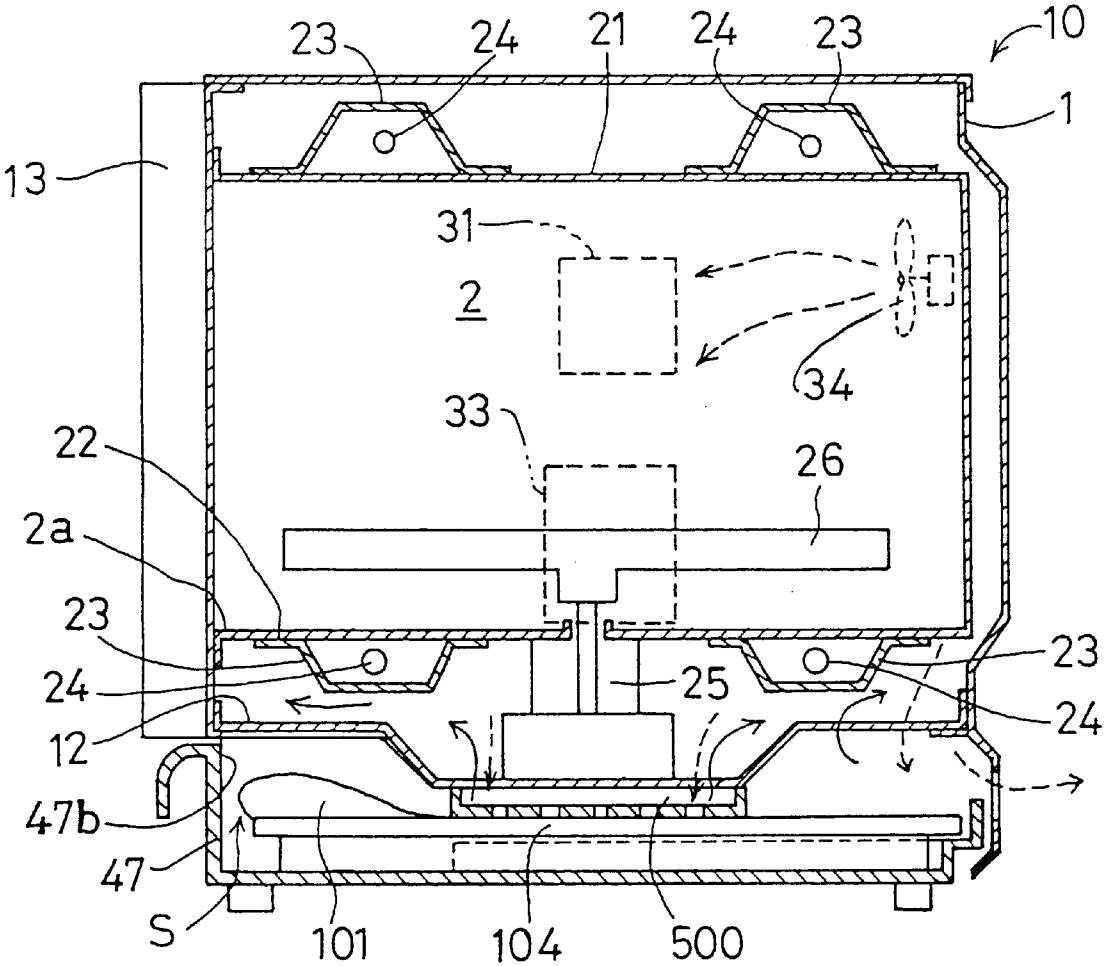
FIG. 17 is a side sectional view of the oven-range having the spacer shown in FIG. 14.

The spacer 500 is fixed under the motor-storing recess 15 of the bottom board 12 in order to ensure the ventilation through ventholes 15*a* provided on the motor-storing recess 15. The spacer 500 protrudes from the motor-storing recess 15 because the base board 501 is a rectangle. At the protruding part, a broad section 503*a* constituting a partially wider side board 503 is disposed so as to be attached onto the motor-storing recess 15 and the base board 12 having ventholes 12*a*, as shown in FIG. 15.

Moreover, this spacer 500 is positioned in such a manner that the two openings formed by the "U"-shaped cross section face to the right and left directions as viewed from the front of the oven range 10. That is, the side board 503 of the spacer 500 is disposed so that the side board 503 stands parallel to the front board 47 of the plate-like body 46.

The reason why the spacer 500 is disposed in such a direction is as follows. That is, if the spacer 500 is disposed in the direction from the front to the back, mittens or the like to be stored will touch an opening part formed by the "U" shape, raising a fear that they cannot be stored well because they will be caught by this opening part. If the spacer 500 is disposed in the direction from the right to the left as in the present invention, mittens or the like can be stored smoothly even if they touch the side board 503, because the side board 503 forms a wall as shown in FIG. 15.

Moreover, the motor-storing recess 15 is disposed to be shifted to the left side of the bottom board 12, as viewed from the front, for placing the high frequency supply section 3 behind the operation panel 14 at the right side of the apparatus body 1. Accordingly, in this embodiment, the spacer 500 is mounted so that the broad section 503*a* is disposed at the left side of the motor-storing recess 15. As a result, the spacer 500 is placed near the ventilation slits 44*a* of the leg bodies 41, thus enabling a more efficient ventilation.

Figure 18:
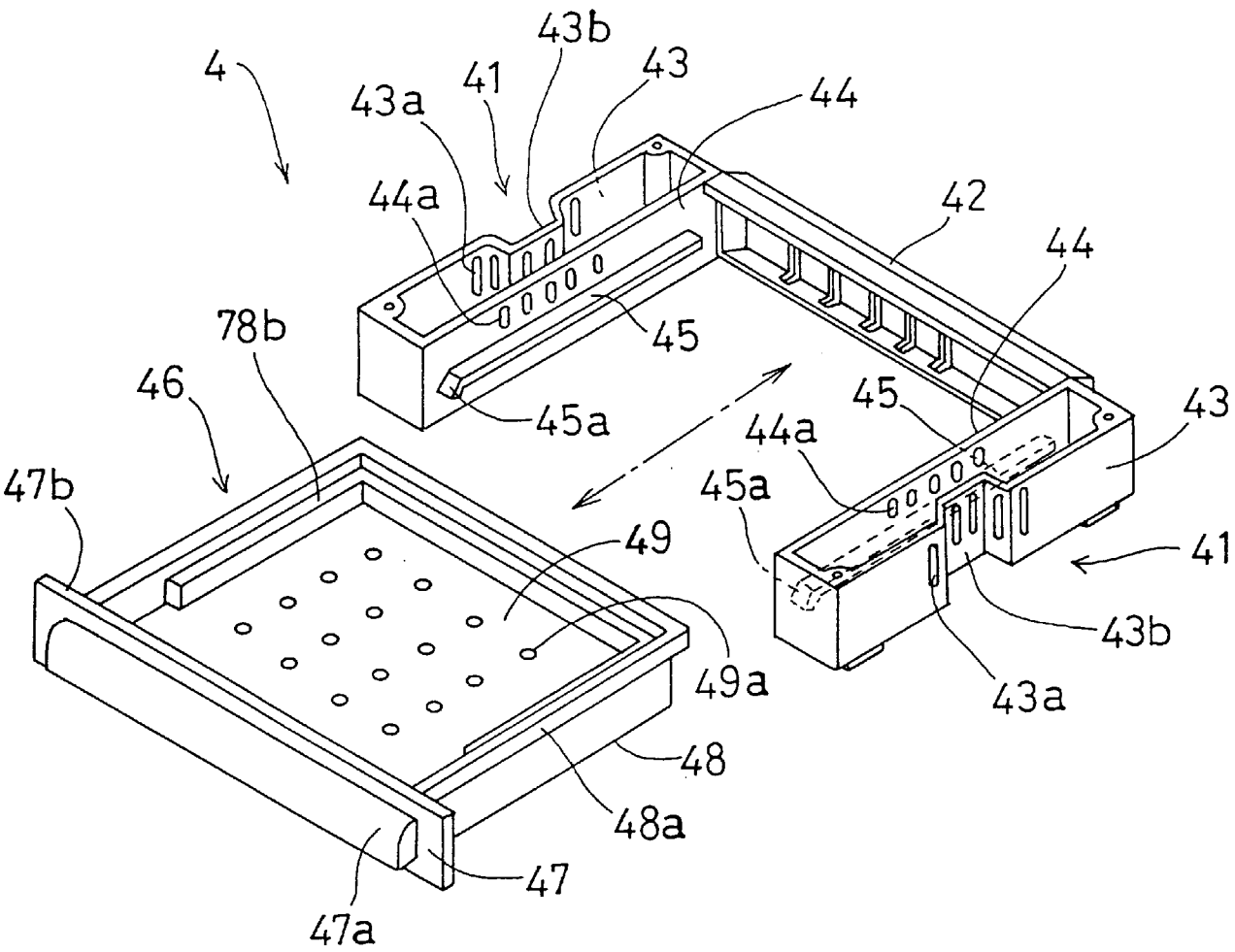
FIG. 18 is a view corresponding to FIG. 7 for explaining another embodiment of the accessory storage section.
Figure 19:
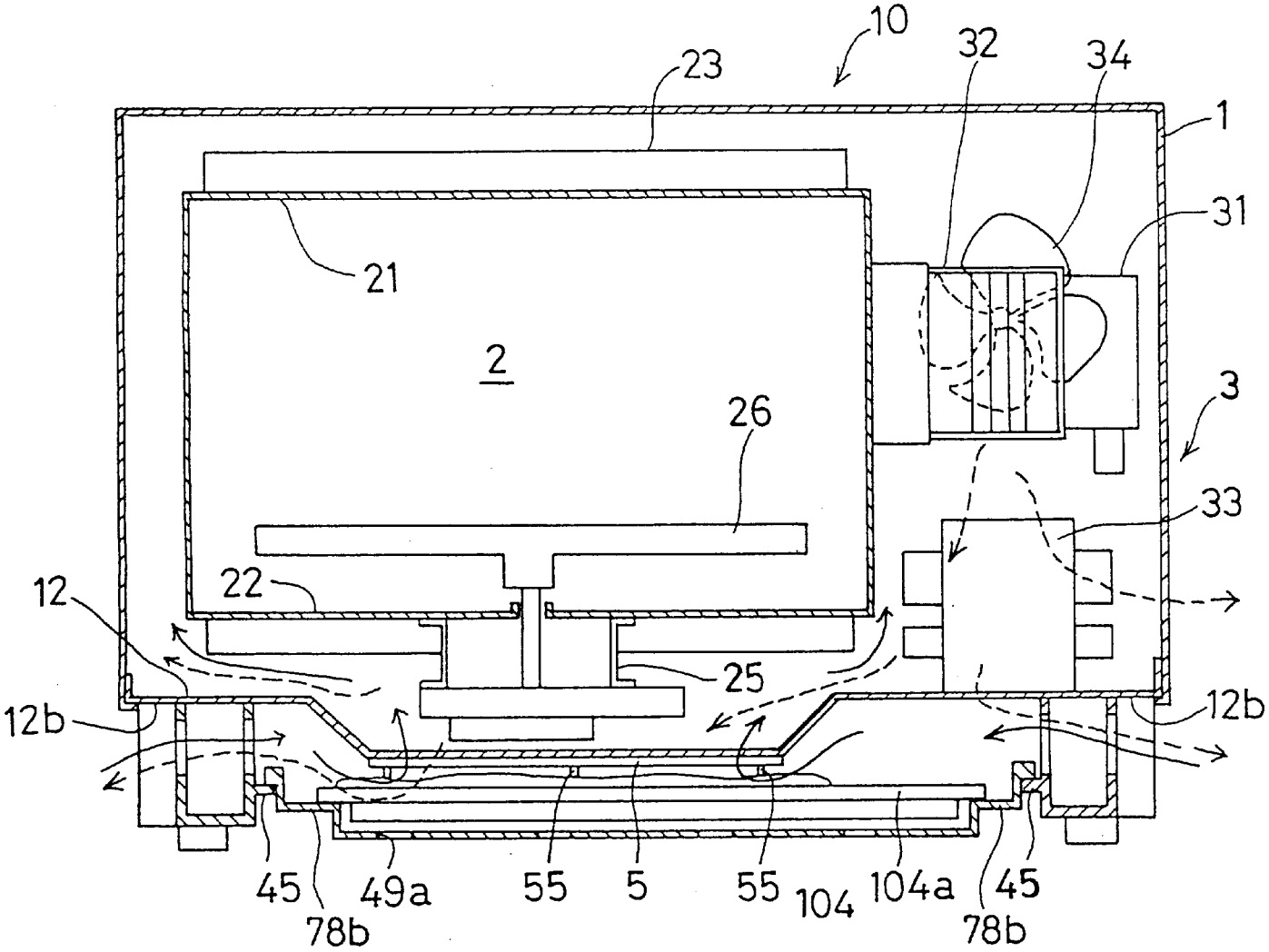
FIG. 19 is a front sectional view of the oven-range provided with the accessory storage section shown in FIG. 18.
Figure 20:
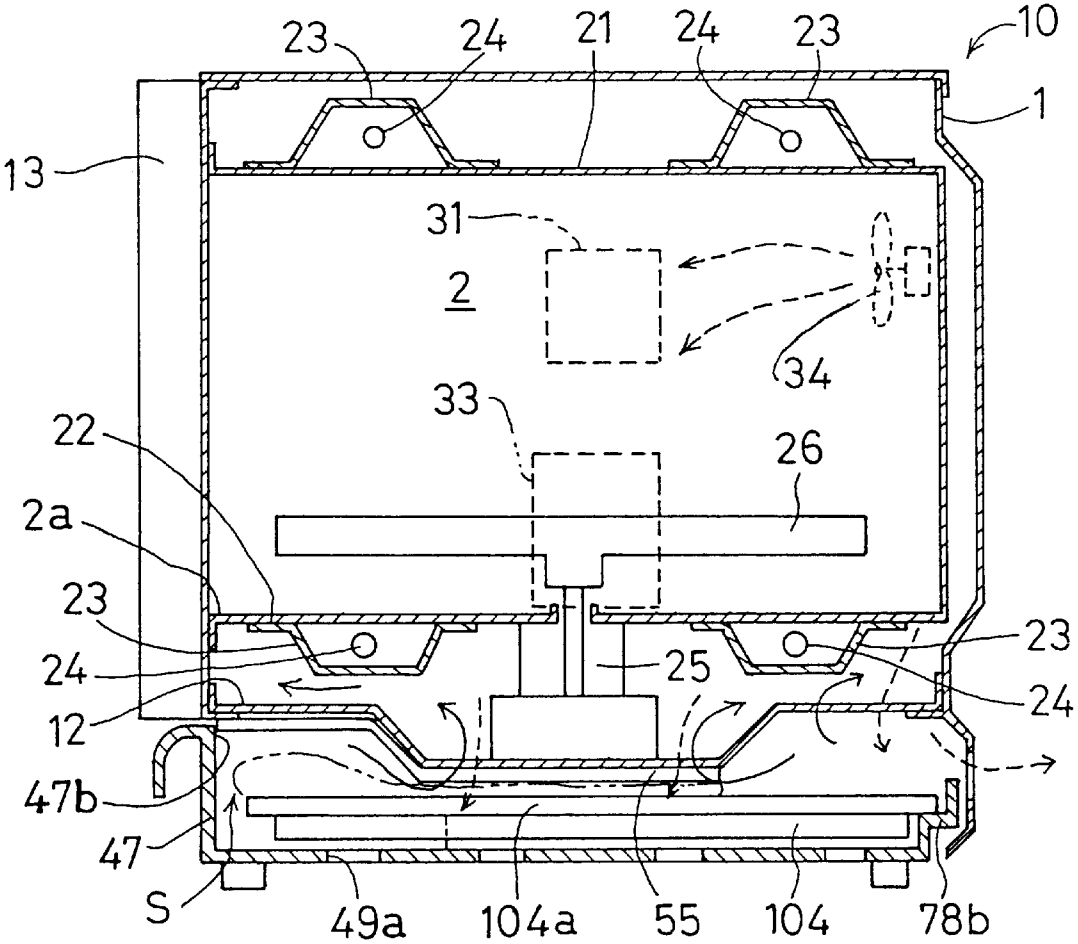
FIG. 20 is a side sectional view of the oven-range provided with the accessory storage section shown in FIG. 18.

FIGS. 18 to 20 show another embodiment of the plate-like body 46 in the accessory storage section 4. Here, a sliding step section 78*b* is formed at three intersecting lines formed by the bottom surface 49 and the right, left and rear side surface of the storage body section. The sliding step section 78*b* protrudes horizontally with a constant width and is formed to lack about a third of the front part in the direction from the front to the back. The sliding step section 78*b* supports accessories to be stored in the plate-like body 46, especially the oven plate mentioned below, keeping them spaced away from the bottom 49 of the storage body section 48. That is, the oven plate 104 is retained in the state of being spaced away from the bottom 49 of the storage body section 48 as shown in FIGS. 18 and 19, thereby preventing the ventholes 49*a* from being blocked by the bottom of the oven plate 104 and securing a space for ventilation.

When an oven heating is conducted, a natural convection generated in the apparatus body 1 by heating of the heater 24 generates, in this space, a cooling air flow that flows to the inside of the apparatus body 1 from the outside. A fresh air flows in through the ventilation slits 43*a* and 44*a* and passes over the plate-like body 46, with a part of the air flowing into the apparatus body 1 through the ventholes 12*a* of the bottom board 12. A part of the fresh air flow passes through a space secured between the bottom surface of the recess 15 of the bottom board 12 and the accessories S by the vertical pressing pieces 55 and flows into the apparatus body 1 through the ventholes 15*a*. Moreover, a fresh air can also be taken in through the ventholes 49*a* formed on the bottom surface 49 of the storage body section 48. By such an air flow, the geared motor 25 and the like are cooled and therefore, a damage of the inside apparatuses can be prevented. Accordingly, because the plate-like body 46 is provided with the step section 78*b*, the oven plate 104 can be kept spaced apart from the bottom of the plate-like body 46 and the accessories S can be easily taken out from the plate-like body 46.

As is apparent from the embodiments of the present invention, the heat cooker of the present invention does not prevent discharge of heat from the inner apparatuses even if the accessory storage section including a structure for inserting the plate-like accessory storage body between the leg bodies is disposed under the bottom board of the cooker body, because the leg bodies constituting the accessory storage section are provided with ventilation slits that form an airway between the inside of the cooker body and the outside through the ventholes of the bottom board of the cooker body and an area above the plate-like body.

What is claimed is:

1. A heat cooker comprising a generally box-like cooker body having ventholes at a bottom board thereof, a heating cavity disposed in the cooker body, a heat source disposed in the cooker body for heating foods in the heating cavity and an accessory storage section disposed under the bottom board of the cooker body, wherein the accessory storage section comprises a plurality of leg bodies which support the cooker body and are attached on both sides of the bottom board, a plate-like accessory storage body which is supported by the leg bodies and inserted between the leg bodies to be capable of being pulled out forward, and ventilation slits within the leg bodies that form an airway between an inside of the cooker body and an outside of the cooker body, the capable of passing air through the ventholes of the bottom board and an area above the plate-like accessory storage body.

2. The heat cooker of claim 1, further comprising a spacer protruding from a lower surface of the bottom board toward an inside of the plate-like accessory storage body to form a space for ventilation between the accessories stored in the plate-like accessory storage body and the bottom board.

3. The heat cooker of claim 1, further comprising a plate disposed in the heating cavity for placing foods thereon, a rotating motor for rotating the plate at the time of heating by the heat source and a motor-storing recess formed by allowing the bottom board to partially protrude downward to store the rotating motor between the heating cavity and the bottom board of the cooker body.

4. The heat cooker of claim 3, further comprising a spacer protruding from a lower surface of the motor-storing recess toward an inside of the plate-like accessory storage body to form a space for ventilation between the accessories stored in the plate-like accessory storage body and the motor-storing recess.

5. The heat cooker of claim 2, wherein the spacer has a "U"-shaped cross section and is disposed on the bottom board to form an airway for ventilation, the airway being parallel to a lower front end of the heating.

6. The heat cooker of claim 2, wherein the spacer comprises at least one elongated projection formed to protrude downward by embossing the bottom board.

7. The heat cooker of claim 1, wherein each of the leg bodies is provided with a guide rail extending in a rearward direction for slidably supporting the plate-like accessory storage body.

8. The heat cooker of claim 1, wherein each of the leg bodies is provided with a recess formed in an outer periphery of said each of the leg bodies to form a handhold surface on both ends of the bottom board for lifting up the cooker body.

9. The heat cooker of claim 8, further comprising a control component disposed beside the heating cavity of the cooker body for supplying electric power to and controlling the heat source, wherein the recess located nearer to the control component is larger than the other recess.

10. The heat cooker of claim 1, wherein the plate-like accessory storage body is provided with a step section disposed at least at one of intersecting lines formed by an inside bottom surface of the plate-like body and right, left and rear side surfaces thereof to center the accessories to be stored in the plate-like body away from at least one side of the plate-like body, the step section being formed to lack a portion of a front part in the direction from the front to the back, whereby an accessory picking space is formed for picking up the accessories stored in the plate-like body.

11. The heat cooker of claim 1, wherein the plate-like accessory storage body is constructed to be capable of being inserted to a position such that the front upper edge of the plate-like body is behind the front upper edge of the heating cavity.

12. The heat cooker of claim 1, wherein the plate-like accessory storage body is provided with ventholes at a bottom part thereof to form an airway between the inside of the cooker body and the outside of the cooker body, the airway capable of passing air through the ventholes of the bottom board and an inside of the plate-like body.

* * * * *